US010712141B2

(12) United States Patent
Muller

(10) Patent No.: US 10,712,141 B2
(45) Date of Patent: Jul. 14, 2020

(54) DETONATOR SENSOR ASSEMBLY

(71) Applicant: DETNET SOUTH AFRICA (PTY) LTD, Johannesburg (ZA)

(72) Inventor: Elmar Lennox Muller, Eldooraigne Centurion (ZA)

(73) Assignee: DETNET SOUTH AFRICA (PTY) LTD., Johannesburg (ZA)

( * ) Notice: Subject to any disclaimer, the term of this patent is extended or adjusted under 35 U.S.C. 154(b) by 0 days.

(21) Appl. No.: 16/349,523

(22) PCT Filed: Nov. 3, 2017

(86) PCT No.: PCT/ZA2017/050082
§ 371 (c)(1),
(2) Date: May 13, 2019

(87) PCT Pub. No.: WO2018/094426
PCT Pub. Date: May 24, 2018

(65) Prior Publication Data

US 2019/0346245 A1 Nov. 14, 2019

(30) Foreign Application Priority Data

Nov. 15, 2016 (ZA) ..... 2016/07861

(51) Int. Cl.
*F42D 1/04* (2006.01)
*C06C 5/04* (2006.01)
(Continued)

(52) U.S. Cl.
CPC ..... *F42D 1/043* (2013.01); *C06C 5/04* (2013.01); *C06C 5/06* (2013.01); *F42D 1/04* (2013.01); *F42C 7/00* (2013.01); *F42C 11/06* (2013.01)

(58) Field of Classification Search
CPC .... F42C 11/06; F42C 7/00; F42D 1/04; F42D 1/043; C06C 5/00; C06C 5/05; C06C 5/06; C06C 5/04
(Continued)

(56) References Cited

U.S. PATENT DOCUMENTS 8,261,663 B2 * 9/2012 Perez Cordova ..... F42D 1/043 102/215
8,695,505 B2 * 4/2014 Koekemoer ..... F42C 15/184 102/206
(Continued)

FOREIGN PATENT DOCUMENTS

AU 2012100109 A4 3/2012
AU 2015201933 A1 5/2015
WO 2012009732 A2 1/2012

OTHER PUBLICATIONS

International Preliminary Report on Patentability for PCT/ZA2017/050082, international filing date of Nov. 3, 2017, dated Oct. 26, 2018, 9 pages.
(Continued)

*Primary Examiner* — James S Bergin
(74) *Attorney, Agent, or Firm* — Cantor Colburn LLP

(57) ABSTRACT

A sensor assembly for use in actuating an electronic detonator in response to a shock tube event propagated through a shock tube, the sensor assembly including support, and at least one sensor on a surface of the support, the support being configured to position the at least one sensor displaced laterally from a line of action of the shock tube event.

2 Claims, 1 Drawing Sheet

(51) Int. Cl.

| | |
|---|---|
| ***C06C 5/06*** | (2006.01) |
| *F42C 7/00* | (2006.01) |
| *F42C 11/06* | (2006.01) |

(58) Field of Classification Search
USPC ..... 102/266, 275.12
See application file for complete search history.

(56) References Cited

U.S. PATENT DOCUMENTS

| | | | | |
|---|---|---|---|---|
| 8,857,339 | B2 * | 10/2014 | Muller | C06C 5/06 102/206 |
| 8,967,048 | B2 * | 3/2015 | Harding | F42B 3/121 102/206 |
| 8,991,315 | B2 * | 3/2015 | Koekemoer | F42D 1/04 102/206 |
| 9,091,520 | B2 * | 7/2015 | Muller | F42D 1/05 |
| 9,279,645 | B2 * | 3/2016 | Schlenter | F42B 3/10 |
| 9,625,244 | B2 * | 4/2017 | Harding | F42B 3/121 |
| 10,527,395 | B2 * | 1/2020 | Labuschagne | F42C 11/06 |
| 2011/0155012 | A1 | 6/2011 | Perez Cordova et al. | |
| 2012/0111216 | A1 * | 5/2012 | Koekemoer | F42C 15/184 102/201 |
| 2013/0255521 | A1 | 10/2013 | Muller et al. | |

OTHER PUBLICATIONS

International Search Report for PCT/ZA2017/050082, international filing date of Nov. 3, 2017, dated Feb. 1, 2018, 4 pages.
Written Opinion for PCT/ZA2017/050082, international filing date of Nov. 3, 2017, dated Feb. 1, 2018, 6 pages.

* cited by examiner

DETONATOR SENSOR ASSEMBLY

CROSS-REFERENCE TO RELATED APPLICATIONS

This application is a U.S. national stage application of International Application No. PCT/ZA2017/050082 entitled "DETONATOR SENSOR ASSEMBLY", which has an international filing date of 3 Nov. 2017, and which claims priority to South African Patent Application No. 2016/07861, filed 15 Nov. 2016.

BACKGROUND OF THE INVENTION

This invention relates to a sensing assembly for use with in a blasting system. In particular the invention relates to a sensing assembly that is operable to actuate an electronic detonator upon sensing a shock tube event without exposing a sensor on the assembly directly to a physical process resulting from signal propagation by a shock tube.

WO2012/009732 describes a timing module for use within a detonating system which includes discriminating and validating arrangements which sense and validate parameter characteristics produced by a shock tube event, and an electronic timer which executes a timing interval in response thereto. An end of a shock tube is connected via a coupling to a housing which contains the timing module. Various sensors are arranged in the coupling so that the sensors are exposed to a shock tube event resulting from signal propagation by the shock tube.

The shock tube event produces gasses and particles at high pressures and high temperatures which can be sufficiently severe to damage the sensors which are exposed to the event, before the sensors can complete their detecting and sensing functions and relay data thereon to downstream electronic circuiting. This, in turn, can result in a malfunction of the detonator.

An aim of the invention is to provide a sensor assembly to address, at least in part, the aforementioned situation.

SUMMARY OF THE INVENTION

The invention provides a sensor assembly for use in actuating an electronic detonator in response to a shock tube event propagated through a shock tube, the sensor assembly including a support, and at least one sensor on a surface of the support, the support being configured to position the at least one sensor displaced laterally from a line of action of the shock tube event.

The support may be shaped in a curve or tube with a surface, e.g. an inner surface, on which the sensor is located. The support may be flexible or malleable.

The support may be positioned in a housing which is connectable to an end of the shock tube. The shock tube event may exit the end of the shock tube and may then be exposed to the sensor which is displaced from the line of action.

The housing may include a protective formation to shield or protect the sensor from potentially adverse effects of the event. The formation may be made from a transparent and flexible material.

Alternatively, the support may be placed to surround the shock tube, at least partly circumferentially, with the sensor facing an outer surface of the shock tube.

A plurality of sensors may be located on the support. The plurality of sensors may be selected at least from the following a light sensor, a pressure sensor and a plasma sensor for respectively sensing light changes, pressure changes and plasma generated by the shock tube event.

At least a part of a wall of the shock tube may be transparent to allow detection of certain parameters associated with the shock tube event.

The light sensor may be an organic photovoltaic sensor or a photodiode capable of detecting light traveling down or emitted by the shock tube.

The pressure sensor may be of any suitable kind such as a piezoresistive strain gauge, a capacitive pressure sensor, an electromagnetic pressure sensor, a piezoelectric sensor, an optical pressure sensor, a potentiometeric pressure sensor, a resonant pressure sensor, a thermal pressure sensor, or an ionization pressure sensor.

The pressure sensor may be exposed to a space of a defined and confined volume into which or within which the shock tube terminates.

The plasma sensor may comprise a pad, which may be a flexible or a curved pad, on which a conductive pattern is placed. The pad may consist of an organic material, metal oxides or any other suitable material, which may be flexible, and the conductive pattern may be a suitable conductive printable material and may for example comprise a copper circuit with a gold overlay.

BRIEF DESCRIPTION OF THE DRAWINGS

The invention is further described by way of examples with reference to the accompanying drawings wherein.

DETAILED DESCRIPTION OF THE INVENTION

Figure 1A:
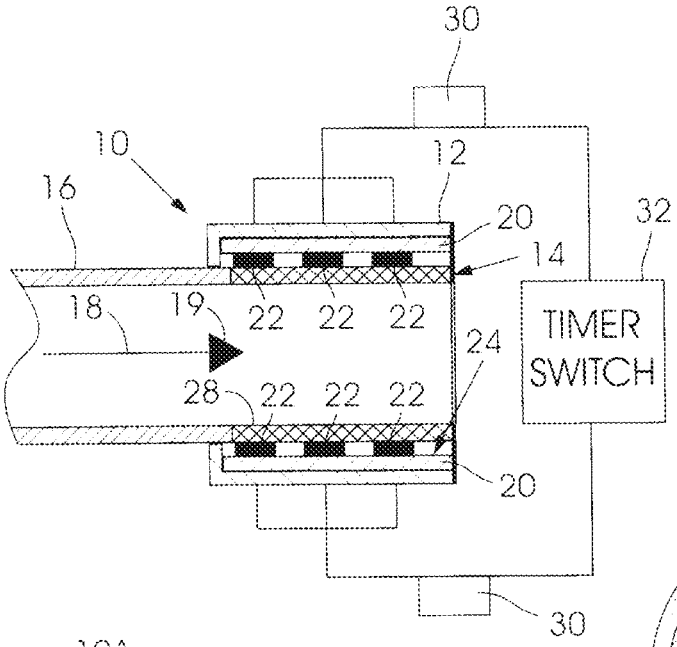
FIG. 1A is a cross-sectional longitudinal view of a portion of a sensing assembly according to a first embodiment of the invention.
Figure 1B:
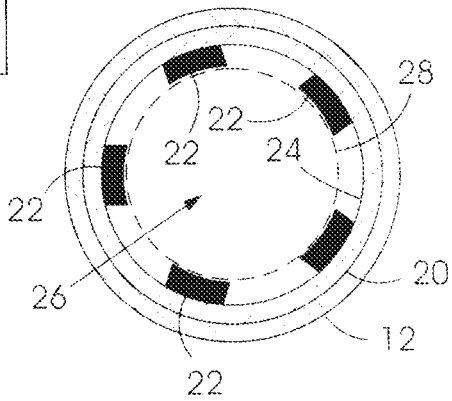
FIG. 1B is an end view of the sensing assembly of FIG. 1A.

FIGS. 1A and 1B show a first embodiment of a sensing assembly 10 contained in a housing 12 connected to an end 14 of a shock tube 16 through which a shock wave 18 is propagated in an axial or longitudinal direction 19.

The sensing assembly 10 includes a support 20 made from a flexible substrate. A plurality of sensors 22, configured to detect parameters specifically and uniquely associated with a genuine shock tube event, is located on a surface 24 of the support 20. The support 20 is rolled into a cylinder 25 (FIG. 1B), with the surface 24 facing towards an interior 26 of the cylinder 25. A transparent, flexible screen 28 covers the sensors 22.

In use, the shock wave 18 is propagated into the interior 26 of the cylinder and the sensors 22, protected by the screen 28, sense signals associated with different parameters which are uniquely linked to the shock wave. Data of the sensed signals are sent to a processor 30 to verify that the signals are indeed originated by a genuine shock tube event. The processor 30 sends a signal to a switch 32 which activates a timer to time detonation of an electronic detonator (not shown).

Figure 2:
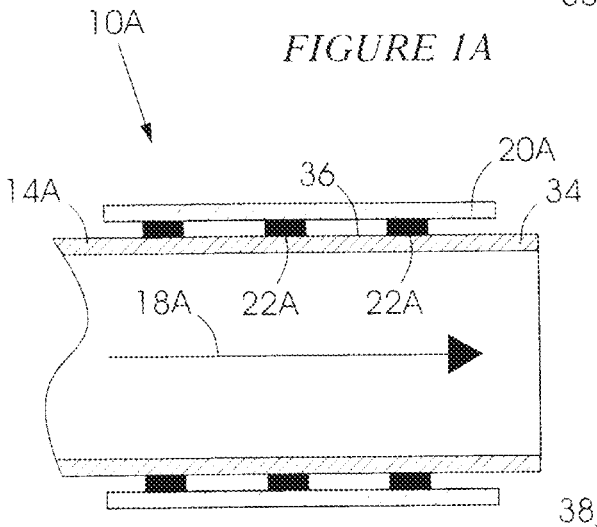
FIG. 2 is a view of a sensing assembly according to a second embodiment of the invention.

FIG. 2 shows another embodiment of a sensing assembly 10A where a support 20A is configured to be wrapped around a wall 34 of a shock tube 14A. The shock tube wall 34 is preferably transparent. An assembly of sensors 22A faces an outer surface 36 of the wall 34. A shockwave 18A, propagated through the shock tube 14A, is detected by the sensors 22A and signals produced by the respective sensors are verified in the same manner as previously described.

In the first embodiment, which is illustrated in FIGS. 1A and 1B, the sensors are a combination of light sensors, pressure sensors and plasma sensors. Only light sensors are suitable for use in the second embodiment, which is illustrated in FIG. 2.

The light sensors are generally organic photovoltaic sensors capable of sensing a light signal through the screen 28, or the wall 36, in the first and second embodiments, respectively. If the signal has the appropriate characteristics, then the light signal is verified by the processor 30 and a command is sent to the timer switch 32. An output of the organic photovoltaic sensor can be optimised to respond in less than 50 micro seconds.

Each pressure sensor is selected from the following; a piezoresistive strain gauge, a capacitive pressure sensor, an electromagnetic pressure sensor, a piezoelectric sensor, an optical pressure sensor, a potentiometeric pressure sensor, a resonant pressure sensor, a thermal pressure sensor and an ionization pressure sensor. The pressure sensor is in a confined volume of a size defined by the housing 12. The shockwave 18 which exits the shock tube 16 at the end 14 enters the volume. A pressure signal produced by the sensor is verified and processed in the manner which has been described in the case of the light sensor.

Figure 3:
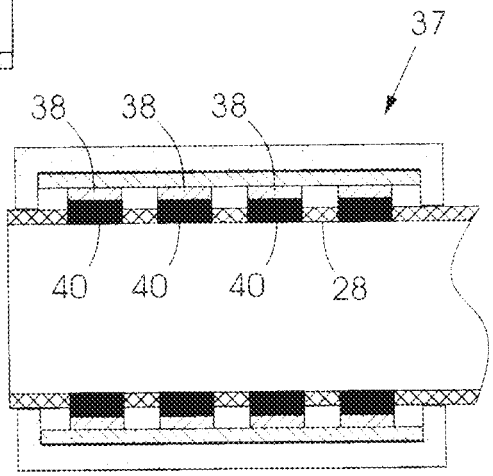
FIG. 3 shows a plasma sensor used in the sensing assembly of FIGS. 1A and 1B.

FIG. 3 shows a plasma sensor suitable for use in the sensing assembly 10 of the first embodiment, which is shown in FIGS. 1A and 1B. The sensor includes the support 20, which is made from an organic material or a metal oxide, and four interconnected contacts 38, made from a copper circuit with a gold overlay, which are located in or on the support. The contacts 38 are connected to conductive tracks or rods 40 which extend through the protective screen 28. The contacts 38, in response to a plasma pulse propagating through the interior 26, generate a signal which is dependent on a change in the conductivity between the contacts. The signal is propagated via the tracks 40 to a processor for verification in the manner described.

The pressure and plasma sensors are not suitable for use with the second embodiment, which is illustrated in FIG. 2.

Due to the protection provided to the sensors by means of the screen 28 in the first embodiment and by the wall 36 in the second embodiment, the sensors are not damaged by the shock tube event and the risk of data not being processed due to damaged sensors is substantially diminished.

The invention claimed is:

1. In combination a sensor assembly and a shock tube, wherein the sensor assembly is used in actuating an electronic detonator in response to a shock tube event propagated through the shock tube, the sensor assembly including a cylindrical support, a plurality of sensors arranged circumferentially on an inner surface of the cylindrical support and a screen over the sensors, the support being configured to define an interior, located at an end of the shock tube, into which a shock wave is propagated in an axial direction along a line of action and with the plurality of sensors displaced laterally from the line of action.

2. A combination according to claim 1 wherein the plurality of sensors is selected at least from a light sensor, a pressure sensor, and a plasma sensor, for respectively sensing light changes, pressure changes and plasma generated by the shock tube event.

* * * * *